United States Patent [19]

McDowell

[11] 4,435,689

[45] Mar. 6, 1984

[54] BROADBAND SLOW WAVE STRUCTURE ATTENUATOR

[75] Inventor: Hunter L. McDowell, Concord, Mass.

[73] Assignee: The United States of America as represented by the Secretary of the Army, Washington, D.C.

[21] Appl. No.: 376,314

[22] Filed: May 10, 1982

[51] Int. Cl.[3] ..... H01P 1/22

[52] U.S. Cl. ..... 333/81 A; 333/161

[58] Field of Search ..... 333/81 R, 81 A, 161, 333/156; 338/21, 334

[56] References Cited

U.S. PATENT DOCUMENTS 3,328,629 6/1967 Newland ..... 315/3.5

3,925,738 12/1975 Bates et al. ..... 333/161

*Primary Examiner*—Paul L. Gensler

*Assistant Examiner*—Benny Lee

*Attorney, Agent, or Firm*—Robert P. Gibson; Jeremiah G. Murray; Edward P. Griffin, Jr.

[57] ABSTRACT

A broadband attenuator section in a meander line slow wave structure is disclosed for attenuating signals reflected between the output and input of the slow wave structure. The attenuator section comprises a multi-element ceramic support structure intermediate the meander line conductor pattern and the substrate wherein the support elements are comprised of a beryllium oxide-silicon carbide ceramic composition with a taper in the percentage of silicon carbide being provided in the transition region from a loss free section of the slow wave structure to a lossy attenuator section. The taper in percentage involves the use of ceramic support elements arranged in a sequence of 1%, 2% and 5% silicon carbide composition prior to the main attenuator section which is comprised of 10% silicon carbide - 90% beryllium oxide support elements.

18 Claims, 2 Drawing Figures

BROADBAND SLOW WAVE STRUCTURE ATTENUATOR

The Government has rights in this invention pursuant to Contract No. DAAB07-72-C-0273 awarded by the Department of the Army.

CROSS REFERENCE TO RELATED APPLICATION

This application is related to U.S. Ser. No. 376,315, entitled, "Frequency Selective Side Absorber For A Meander Line", filed on May 10, 1982, in the name of Hunter L. McDowell, the subject inventor. This invention is also assigned to the present assignee.

BACKGROUND OF THE INVENTION

This invention relates generally to slow wave structures for the propagation of electromagnetic energy and more particularly to a broadband slow wave attenuator therefor.

Attenuators for signals reflected between the output and input of a slow wave structure are generally known. A typical example of a prior art attenuator comprises a structure which includes iron plating a portion of the slow wave structure to fabricate the attenuator. The amount of attenuation obtainable by this method has been found less than desirable when utilized in connection with a microwave signal amplifier of the crossed field amplifier type. Thus the signal gain obtainable is appreciably limited. In addition, the reproducibility of the iron plating has been found to be less than adequate and the cost of its inclusion on the structure is relatively expensive because of the complications introduced into the fabrication process.

Accordingly, it is an object of the present invention to provide an improved signal attenuator incorporated in a slow wave structure.

It is another object of the present invention to provide a broadband attenuator section in a meander line slow wave structure for inhibiting oscillations which can build up due to the reflection of energy between the input and output of the structure.

It is still a further object of the present invention to provide a broadband attenuator for use in a meander line slow wave structure whose attenuation per unit length of the attenuator may be varied over a relatively wide range.

SUMMARY

These and other objects are achieved in accordance with broadband attenuator means in a section of a meander line slow wave structure where the meander line is comprised of a serpentine conductor pattern positioned over a ground plane and the attenuator section includes a plurality of support elements having a ceramic composition consisting of beryllium oxide and silicon carbide. The attenuator section additionally includes a taper in the percentage of silicon carbide from the loss free section of the slow wave structure to the attenuator or lossy section of the slow wave structure.

BRIEF DESCRIPTION OF THE DRAWING

While the present invention is described in particularity for providing the basis of the claims annexed to and forming a part of this specification, a better understanding of the invention can be obtained by reference to the following description taken in conjunction with the accompanying drawing in which:

DESCRIPTION OF THE PREFERRED EMBODIMENT

Figure 1:
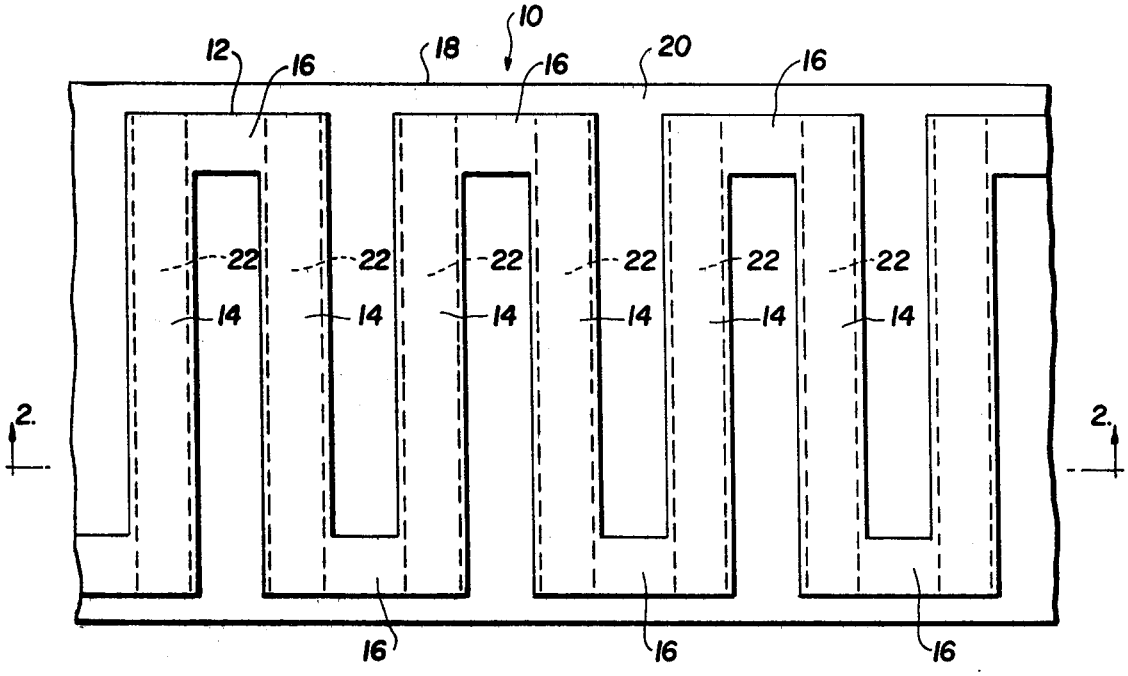
FIG. 1 is a fragmentary top planar view of a meander line slow wave structure in accordance with the subject invention.

Referring now to the drawings and more particularly to FIG. 1, reference numeral 10 designates a meander line slow wave structure utilized, for example, in a well known high power injected beam or emitting sole crossed-field amplifier or traveling wave tube which is typically utilized to amplify microwave signals. The slow wave structure as shown is comprised of a plurality of elongated substantially linear finger-like segments 14 which are connected in series by a plurality of relatively shorter substantially linear advance segments 16. Both the long and short segments 14 and 16 are of a constant width providing a uniform configuration having squared corners. As is well known, the meander line is comprised of a metal conductor such as copper which is formed on a substrate or base member 18 having an upper conductive surface 20 which acts as a ground plane. In the subject invention, the metallized meander line 12 is supported above the ground plane 20 by a plurality of ceramic support elements in the shape of elongated bars 22 which are positioned beneath the transverse meander line segments 14 and are secured to the substrate by respective slots formed in the ground plane surface 20.

As is well known, a microwave signal launched on the meander line 12 from a source, not shown, is adapted to travel from an input port, also not shown, in a direction transverse to the elongated segments 14 of the meander line to an output port. In order to selectively attenuate signal translation and/or inhibit signal reflections between the output and input ports, for preventing any oscillations from building up along the line due to signal reflection, attenuator means are normally employed. In the present invention, the attenuator means comprise the utilization of lossy ceramic support bars in the section of the slow wave structure 10 requiring attenuation while using substantially loss free ceramic bars for supporting the meander line 12 where little or no attenuation is desired. An example of a loss free ceramic is a beryllium oxide, commonly referred to as beryllia. An example of a lossy ceramic is a composition of beryllium oxide which contains a predetermined amount of silicon carbide.

Figure 2:
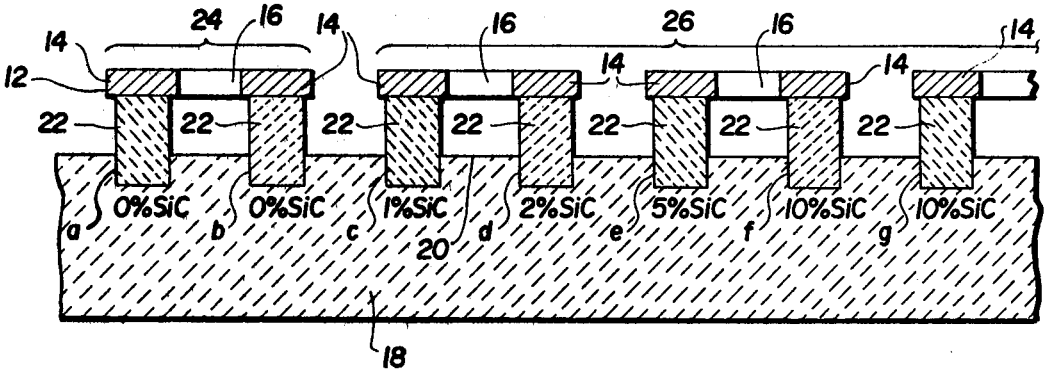
FIG. 2 is a sectional view of the slow wave structure shown in FIG. 1 taken along the lines 2—2 thereof.

Referring now to FIG. 2, reference numeral 24 denotes a loss free section of the slow wave structure 10 while reference numeral 26 denotes the preferred embodiment of an attenuator section therefor. What is significant about the configuration is that the two support bars a and b in the non attenuated section 24 are comprised of substantially 100% beryllium oxide with 0% silicon carbide, while the support bars c, d, e, f and g in the attenuator section 26 comprise beryllium oxide support bars with specific concentrations of silicon carbide, as shown. Moreover, the attenuator section 26 is matched to the loss free section 24 by a taper in the percentage of the silicon carbide in the bars c, d, e, f and g. As shown, support bar c has a 1% concentration of silicon carbide while sections d,e and f have concentrations of 2%, 5% and 10% silicon carbide, respectively.

The bar g also indicates that a 10% concentration of silicon carbide is utilized. This is meant to indicate that the main portion of the attenuator section employs a 10% silicon carbide—90% beryllium or beryllia ceramic composition. While not shown, the other end of the attenuator section 26 can include, when desirable, a concentration taper in the opposition direction, i.e. 10%, 5%, 2% and 1%.

In a slow wave structure as shown in FIGS. 1 and 2, an attenuator with a 10% silicon carbide—90% beryllium oxide ceramic bar attenuator section can provide a typical value of 5 dB/inch attenuation in C band as compared to a maximum 4 dB/inch attenuation which has been obtainable with prior art apparatus referred to above wherein iron plating has been used to implement the attenuator section. Even higher values of attenuation per unit length may be obtained using a higher percentage of silicon carbide. The use of the beryllium oxide bars loaded with silicon carbide has the advantage over iron plating in that a significant simplification of the fabrication process is achieved. The iron plating fabrication process was previously required on both the meander line and the substrate or base to obtain an achievable 4 dB/inch loss. To maintain a fixed height from the substrate to the top of the meander line, both the line and base portions were masked to prevent their being plated on the surfaces which are in contact with the meander line. This masking process proved to be exceedingly tedious. Furthermore, the build up of iron plating on the line made the elongated line finger segments in the attenuator section slightly larger than the rest of the meander line. The plating thickness varied somewhat from line to line and the precision of locating the line in a brazing fixture proved to be even more difficult.

In summation, what has been shown and described is an attenuating section fabricated in a broadband slow wave meander line structure using beryllium oxide—silicon carbide bars for supporting the meander line and with the composition of the percentage of silicon carbide having a taper in the percentage from the loss free portion of the slow wave structure to the lossy portion of the slow wave structure. When desirable, bars comprised of carbon loaded porous alumina may be substituted for beryllium oxide—silicon carbide.

Having shown and described what is at present considered to be the preferred embodiment of the invention, it is to be understood that the foregoing has been made by way of illustration and not limitation and accordingly all alterations, modifications and changes coming within the spirit and scope of the invention as defined in the appended claims are meant to be included.

I claim as my invention:

1. A broadband slow wave structure for propagating electrical energy including an attenuator section, comprising in combination:

dielectric substrate means having an upper conductive surface;

meander line circuit means including a serpentine electrical conductor pattern supported on said substrate means; and support means in the region of said attenuator section consisting of a plurality of attenuator elements intermediate said conductor pattern and said substrate means.

2. The slow wave structure as defined by claim 1 wherein said plurality of attenuator elements are comprised of lossy ceramic support members.

3. The slow wave structure as defined by claim 2 wherein said ceramic support members are comprised of a composition of beryllium oxide and silicon carbide.

4. The slow wave structure as defined by claim 2 wherein said ceramic support members are comprised of carbon loaded porous alumina.

5. The slow wave structure as defined by claim 2 wherein said support members are comprised of a plurality of elongated bar type members.

6. The slow wave structure as defined by claim 5 wherein a predetermined number of said plurality of bar type members have mutually different percentage concentrations of silicon carbide.

7. The slow wave structure as defined by claim 6 wherein the percentage concentration of silicon carbide ranges between zero and at least 10% silicon carbide.

8. The slow wave structure as defined by claim 7 wherein said percentage concentration varies in an ordered sequence.

9. The slow wave structure as defined by claim 8 wherein said ordered sequence comprises a tapered percentage concentration from a relatively low percentage of silicon carbide to a relatively higher percentage of silicon carbide.

10. The slow wave structure as defined by claim 9 wherein said relatively low percentage concentration of silicon carbide is on the order of 1% silicon carbide and said relatively higher percentage concentration is substantially 10% silicon carbide.

11. The slow wave structure as defined by claim 10 wherein said serpentine conductor pattern is comprised of a plurality of elongated electrical conductor segments connected in series by a plurality of relatively shorter electrical conductor segments forming a composite structure thereby and wherein said support means comprises a plurality of elongated members of ceramic material located substantially coextensively under selected ones of said plurality of elongated conductor segments.

12. The slow wave structure as defined by claim 11 wherein said plurality of elongated conductor segments are substantially linear and parallel and said relatively shorter conductor segments are substantially linear and parallel and mutually transverse to said elongated segments thereby forming a right angled serpentine structure and wherein said elongated bars of lossy ceramic support material are substantially linear and positioned substantially parallel under said selected ones of elongated conductor segments.

13. The slow wave structure as defined by claim 1 and additionally including a substantially non-attenuated section and support means therefor comprising relatively loss free support elements intermediate said conductor pattern and said substrate means.

14. The slow wave structure as defined by claim 13 wherein said loss free support elements comprise at least one ceramic support member comprised of beryllium oxide and said attenuator elements are comprised of a composition of beryllium oxide and silicon carbide.

15. The slow wave structure as defined by claim 14 wherein said at least one ceramic support member is comprised of an elongated bar type member which is adjacent the first of said plurality of said attenuator elements and wherein said attenuator elements include a plurality of bar type members having a tapered concentration of silicon carbide to provide a region of transition between said non-attenuated section and said attenuator section.

16. The slow wave structure as defined by claim 15 wherein the percentage of concentration of silicon carbide in said region of transition varies in discrete steps between zero and at least 1O% and followed by an attenuation region wherein the percentage of concentration of silicon carbide is substantially constant.

17. The slow wave structure as defined by claim 16 wherein said steps of concentration comprise 1%, 2%, 5% and 10% silicon carbide.

18. The slow wave structure as defined by claim 16 wherein the percentage of substantially constant concentration of silicon carbide is at least 10%.

* * * * *